US006579123B2

(12) United States Patent
Kasahara

(10) Patent No.: US 6,579,123 B2
(45) Date of Patent: Jun. 17, 2003

(54) CONNECTOR ATTACHMENT STRUCTURE

(75) Inventor: Katsunori Kasahara, Fuchu (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/081,850

(22) Filed: Feb. 20, 2002

(65) Prior Publication Data

US 2002/0168893 A1 Nov. 14, 2002

(30) Foreign Application Priority Data

Feb. 21, 2001 (JP) ..... 2001-45439

(51) Int. Cl.[7] ..... H01R 13/73
(52) U.S. Cl. ..... 439/573
(58) Field of Search ..... 439/570, 573

(56) References Cited

U.S. PATENT DOCUMENTS 6,183,295 B1 * 2/2001 Hashimoto ..... 439/573
6,227,906 B1 * 5/2001 Fan ..... 439/570
6,254,429 B1 * 7/2001 Morita ..... 439/570
6,371,803 B1 * 4/2002 Fan ..... 439/573

* cited by examiner

*Primary Examiner*—Gary Paumen
(74) *Attorney, Agent, or Firm*—Thomas D. Paulius

(57) ABSTRACT

This invention provides a fixing structure for fixing a connector to the surface of a circuit board. It facilitates management of screw-tightening torque, and has reliability at the time of fixture by screwing, and reliability over time. When fixed to a board using a screw, the connector is not fixed directly to the circuit board, but rather a bracket with two arms that contact and engage protruding portions of the connector hold the connector down on the board. A main body portion of the bracket is defined by folding a portion upon itself to present a U-shape. The folded piece can compress under the tightening of the screw and may be soldered to the circuit board.

14 Claims, 6 Drawing Sheets

CONNECTOR ATTACHMENT STRUCTURE

BACKGROUND OF THE INVENTION

The present invention generally relates to the assembly of connectors and more particularly, to a connector fixing structure and methods used to surface mount connectors to printed circuit boards.

Surface mount connectors are known that are fixed to circuit boards by laying tail portions of the connector on contact pads on the circuit board and soldering the former to the latter with solder. This includes using a soldered component as a fixing structure for a connector. This soldering arrangement provides a fixing force which is unstable and of low reliability.

If the surface mount connector is, for example, a receptacle connector into which a plug connector is inserted or removed, the load acting during the insertion or removal causes a stress on the solder tail portions used for soldering the connector. For this reason, a metal screw or the like is adopted in combination with the soldering as a reinforcing means.

This approach uses a screw which passes through an opening of a connector flange which is then tightened. A problem with this arrangement is that excessive screw-tightening torque can create a compression force which exceeds the physical strength of the connector flange. Consequently, a problem, such as a deformation or a crack in the flange, is caused.

For this reason, the screw-tightening torque is generally set relatively low, and the screw tightening is executed within a region where deformation does not occur. However, this approach causes another problem, in which if the screw tightening is insufficient, the screw will be loosened periodically during mating of the two connectors. Accordingly, it is necessary to determine the screw-tightening torque carefully. Inadequate torque may cause unacceptable screw loosening.

The present invention has been made in order to solve the aforementioned problems, and an object of the present invention is to provide a fixing structure for a connector, which makes it easy to set a screw-tightening torque, and which provides reliable securement not only at the time of fixture by a screw or other attachment member but also after the connector is attached to the circuit board.

SUMMARY OF THE INVENTION

To attain the above-noted object, in providing a fixing structure for a connector according to the present invention, the connector is fixed to a board using a screw member or other attachment member. However, the connector is not fixed directly, but rather a bracket is mounted to the connector and then the bracket is fixed to the board by a suitable attachment member such as a screw.

When the attachment member is tightened to fix the bracket, the bracket is depressed in a direction toward the board, and the connector to which the bracket is mounted is depressed in the direction toward the board, so that the connector is fixed onto the board. With this arrangement, since tightening forces such as a screw-tightening torque caused during tightening of the attachment member acts on the fixed bracket, the load applied to the connector is of a constant quantity.

It is accordingly a general object of the invention to provide an improved approach for surface mounting of an electrical connector onto a board.

Another object of the invention is to provide an approach for connector attachment which improves working efficiency during screw fixing and improves fixing reliability over time of use.

Another object of the present invention is to take into consideration stress imparted to a solder tail portion when a surface mount connector is inserted or removed, thereby providing an improved attachment approach.

Another object of the invention is to provide an improved connector attachment approach which facilitates the management of attachment member tightening torque and extended time reliability of the resulting attachment.

Another object of the present invention is to connect a surface mount connector without using direct pressure of a seat surface of a screw while depressing the connector with a constant quantity substantially regardless of the magnitude of applied screw-tightening torque.

Other objects, aspects and advantages of the present invention will be understood from the following description according to preferred embodiments of the present invention, relevant information concerning which is shown in the accompanying drawings.

BRIEF DESCRIPTION OF THE DRAWINGS

In the course of this description, reference will be made to the attached drawings, wherein.

DESCRIPTION OF THE PREFERRED EMBODIMENTS

Figure 1:
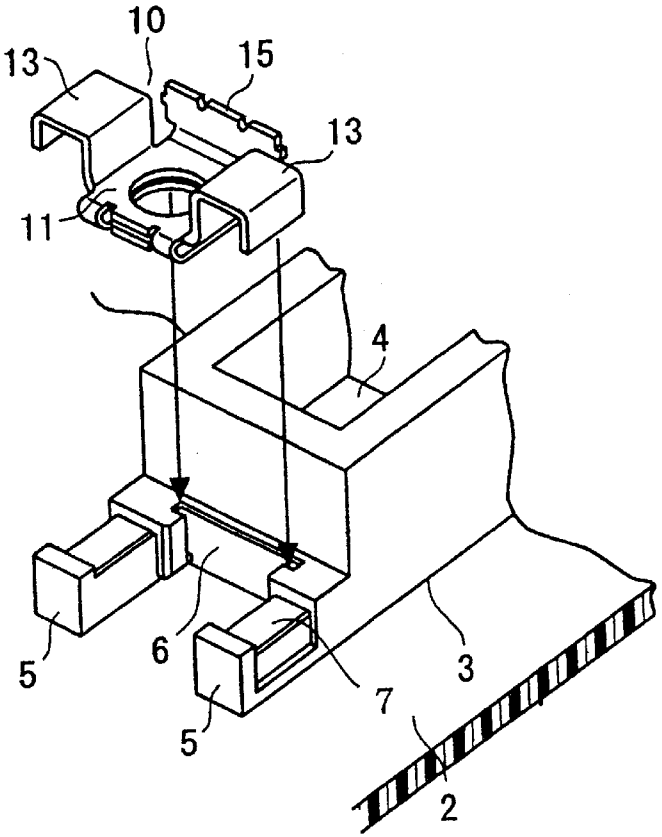
FIG. 1 is a perspective view showing a screw fixing process for a connector constructed in accordance with the principles of the present invention.

The present invention is directed toward an approach for fixing surface mount connectors to circuit boards and the like. A fixing bracket is provided, such as generally illustrated in FIG. 1 as 10. The bracket 10 is shown positioned above its location for mounting a surface mount connector 3 to a circuit board 2.

The connector 3 includes a U-shaped attachment area at its end, and the surface thereof is fixed to the board. A structure such as this makes it possible to suppress rotation of the attachment bracket 10 caused by screw-tightening torque, and to suppress a problem in which unnecessary rotational moment due to excessive screw-tightening torque acts on the connector 3 to cause stress onto a solder tail portion of the connector 3.

In accordance with the invention, the fixing structure for the connector 3, typically a surface mount connector mounted to the circuit board 2, includes a pair of protruding arms, or portions, 5 which are juxtaposed to each other and which protruded from an end wall of a connector housing 4. The attachment bracket 10 is mounted to the protruding portions 5, and a screw member 1 is provided for fixing the attachment bracket 10 to the board. The bracket 10 includes a main body portion 11 that fits between the connector protruding arms 5 and right and left arm portions 13 that engage and clamp the pair of protruding portions. A screw hole 12 is provided in the main body portion 11, through which the screw is passed, and the right and left arm portions 13 are set so that each of the arm portions 13 causes a force for depressing each of the connector protruding arms 5 in a direction toward the board, when the bracket main body portion 11 is fixed onto the circuit board by a screw 1.

By this approach, the connector is not fixed directly by surface pressure caused by a screw seat surface formed as part of the connector housing, but the connector protruding arms 5 are clamped by the arm portions 13 of the bracket 10 to fix the bracket 10 onto the circuit board by using a screw 1. This makes it possible to depress the protruding arms 5 of the connector 3 in a direction toward the board with a force of a constant quantity regardless of the magnitude of the screw-tightening torque.

Figure 11:
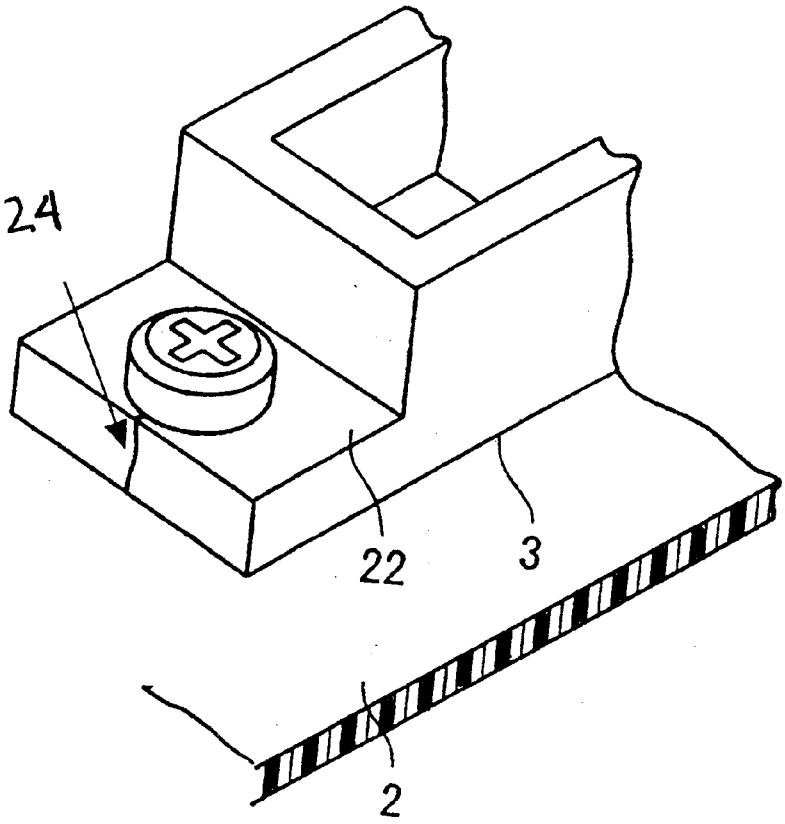
FIG. 11 Prior Art

At the time when the bottom surface of the bracket 10 is closely contacted with the board surface 2, any further movement of the bracket 10 is limited, so that even if the screw-tightening torque is increased, no additional load acts on the connector 3. Thus, the depressing force on the connector 3 is constant and the likelihood of stress cracking in the connector as illustrated in FIG. 11 occurs. Consequently, the connector housing is free from any deformation or breakage, which may otherwise be caused due to excessive screw-tightening torque in the conventional method and product. Further, since the constant fixing force can be obtained within a wide range of screw-tightening torque, the screw-tightening torque can be easily managed.

It is preferred that the attachment bracket 10 is formed by bending or otherwise processing a metal plate into a main body portion 11 which has a flap or piece 14 that is folded over to present a U-shape at 16 and to have a double thickness. The forming is such that one portion (the bottom portion) of the folded piece 14 is contacted with the circuit board surface when the bracket 10 is mounted to the protruding portions. With this arrangement, the lower surface of the folded piece 14 may be preliminarily positioned into close contact with the circuit board surface 2 prior to tightening of the screw 1. Further, if the bracket member is made of a metal, the bracket can be made suitable for soldering, and the folded piece 14 can also be fixed to the board 2 by solder.

By fixing the bracket member 11 to the board 2 in this manner, it is possible to provide the bracket 11 also with the function of a fitting nail, and therefore the bracket 11 can be effectively used as reinforcing means in fixing the connector 3 onto the circuit board 2. Also, it is possible to suppress rotation of the bracket member 11 due to screw-tightening torque. This addresses a problem in which unnecessary rotational moment due to an excessive screw-tightening torque acts on the connector to cause stress onto a solder tail portion of the connector.

Figure 7:
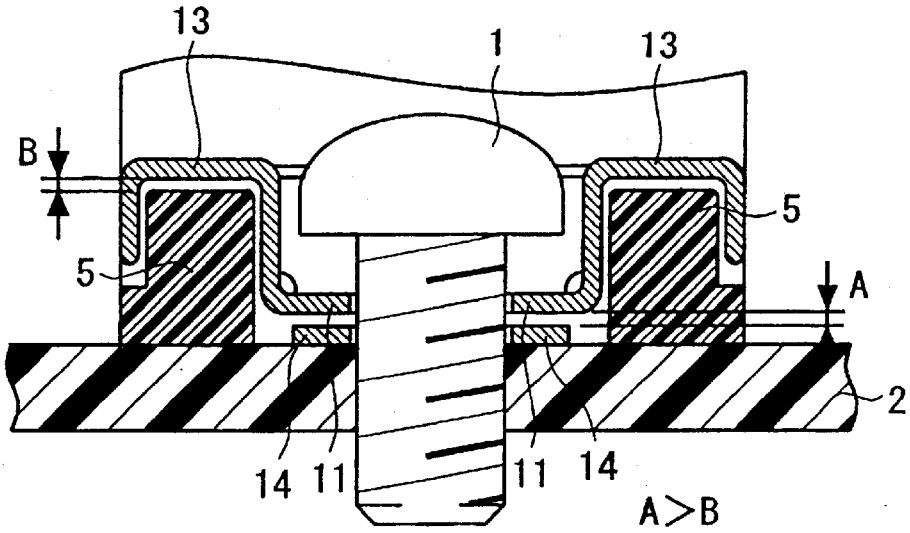
FIG. 7 is a sectional view of FIG. 2 taken along line X—X thereof, with the screw being inserted, but before tightening of the screw when the bracket is fixed to the board.

If the bracket 11 is arranged to have the double structure so that a clearance is formed between the upper and lower surfaces of the folded piece 14, as best illustrated in FIG. 7, the screw for the bracket 11 may be applied even after the lower part of the bracket, i.e. the folded piece 14, is fixed to the board by soldering. Furthermore, this double, or folded structure, also provides the function of a washer, and consequently the loosening of the screw 1 after the screw tightening also can be eliminated.

The protruding portions 5 of the connector 3 are preferably provided with grooves 7 to which the arm portions 13 of the bracket are fitted. When the grooves 7 of the protruding portions are included, the arm portions 13 of the bracket 11 can be easily attached to the connector 3 without any shift of the arms of the bracket on the protruding portions. Further, by fitting therebetween, the positioning of the bracket 11 in a lateral direction can be positively conducted to fix the bracket.

It is preferred that an insertion groove 6 is provided between the pair of protruding arms 5 of the connector 3, and that the attachment bracket 10 has a mounting flange 15 inserted into the insertion groove 6 in order to mount the bracket to the protruding portions. By inserting the bracket mounting piece 15 into the groove 6, the bracket 10 is positioned in a longitudinal direction to be fixed, thereby more firmly mounting the bracket to the protruding portions.

The preferred embodiment of the present invention now is described in further detail. It is noted that, dimensions, material, configuration, relative arrangement or other specifics described in connection with this embodiment should not be interpreted to require limitation on the scope of the present invention. Further, in the drawings, members of the illustrated embodiment which are similar to members which have been shown in the drawings used for explanation of the prior art are denoted by the same reference numerals.

Figure 2:
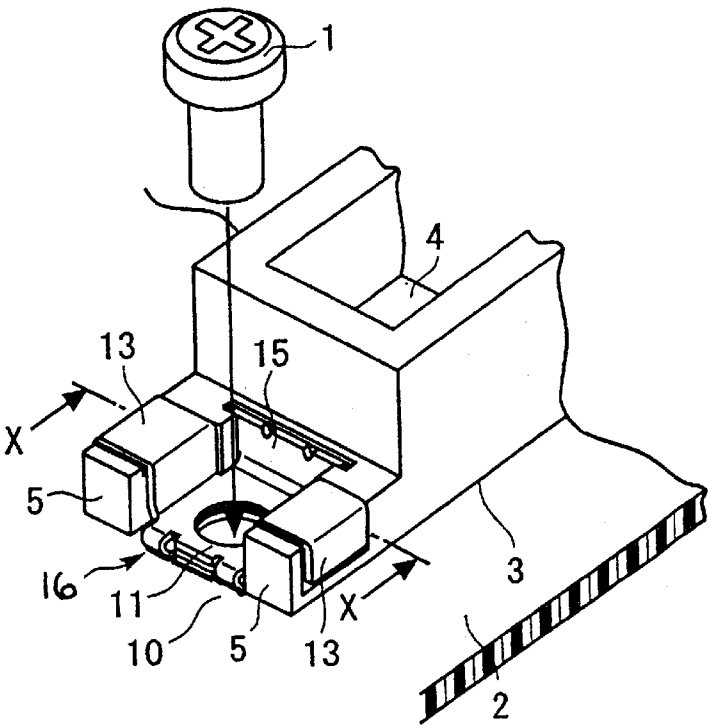
FIG. 2 is the same view as FIG. 1, but illustrating the attachment member in place within the connector.
Figure 3:
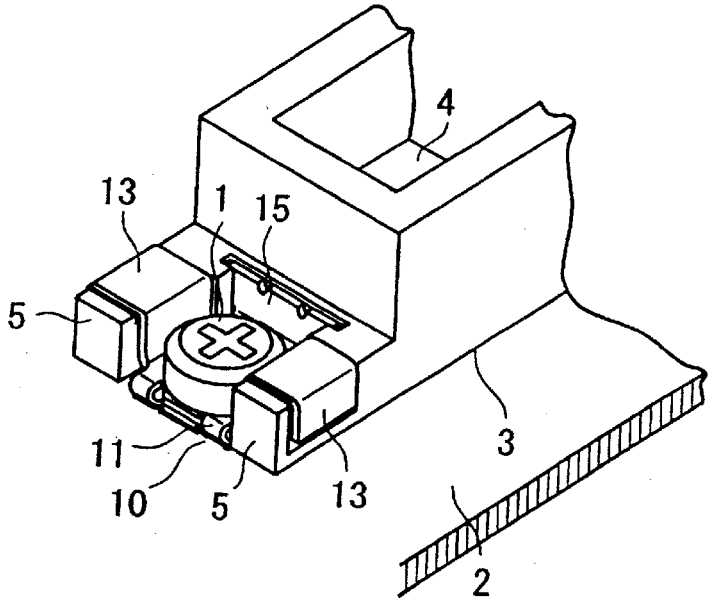
FIG. 3 is the same view as FIG. 2, but with the screw in place within the attachment member.
Figure 4:
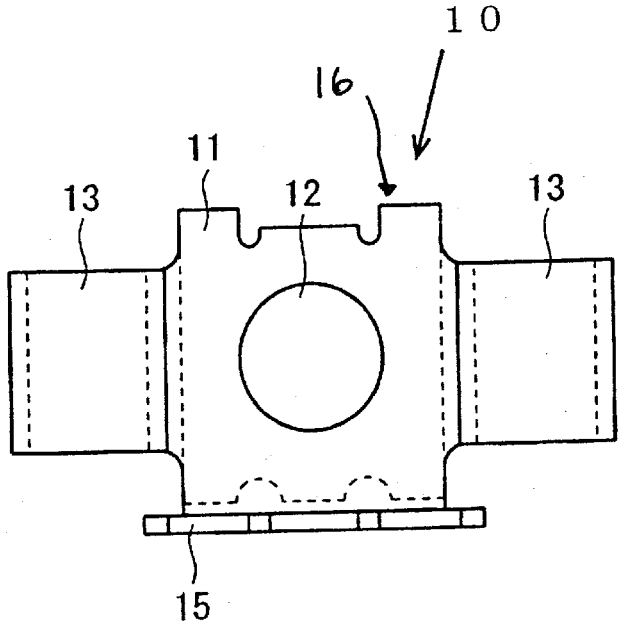
FIG. 4 is a top plan view of an attachment bracket of FIG. 1.
Figure 5:
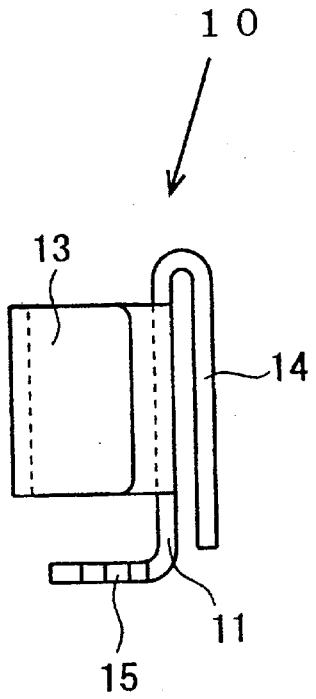
FIG. 5 is a side elevational view of the attachment bracket of FIG. 4.
Figure 6:
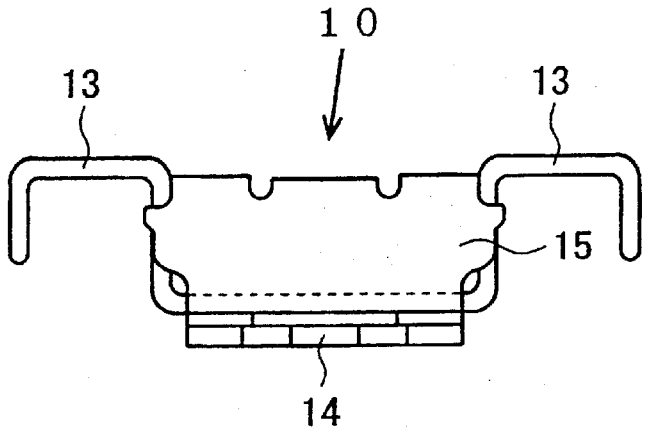
FIG. 6 is a rear elevational view of the attachment bracket of FIG. 4.

With reference to FIGS. 1 to 8, a fixing method according to the present invention, which is especially suitable for SMT (surface mount technology) connectors will be described. Such a SMT connector is represented as connector 3 for this embodiment. FIGS. 4 to 6 schematically show an arrangement of the bracket 10. Main body portion 11 is located at a central portion of the bracket 10, which is formed at its center with the screw hole 12 into which the screw 1 is inserted when the board 2 and the connector 3 are screw-fixed to each other.

The main body portion 11 is provided with the folded piece 14 formed by bending one end downwardly to present a U-shaped configuration along fold line 16. The main body portion 11 and the folded piece 14 may be considered as constituting a double plate base of the bracket 10. The folded piece 14 is to be fixed to the board 2 by soldering or the like such as at 16. (FIG. 2.) The folded piece 14 also is formed with the screw hole 12 equal in size to the hole disposed in the main body portion 11. The screw holes 12 are aligned and overlapped with each other so that the screw 1 is insertable into and through these screw holes 12.

A mounting piece 15 is provided to the main body portion 11, which is located on the opposite end of the end portion where the folded piece 14 is provided, and which extends in the opposite direction from the folded piece 14 and perpendicularly with respect to the main body portion 11. The mounting piece 15 is to be inserted into and fixed in an insertion groove 6 of the connector 3. By this arrangement, the bracket 10 is positioned in a longitudinal direction, which corresponds to the short side direction of the bracket 10.

Arm portions 13 are provided on the main body portion 11, each of which is located on respective remaining end portions adjacent to the end portion where the mounting piece 15 is provided, and each extends in the same direction as the mounting piece 15. The arm portions 13, each being configured like a hook in the illustrated embodiment, are to be fitted to protruding portions 5 of the connector 3 to clamp the protruding portions 5, thereby positioning the bracket 10 in a lateral direction, which corresponds to the long side direction of the bracket 10.

In addition, it is preferred that the bracket 10 is formed by processing a metal plate. The bracket 10 preferably is made of metal so as to conform the bracket 10 so that its returningly folded piece 14 can be solder-fixed to the board 2.

FIGS. 1 to 3 schematically show a process of screw fixing the connector 3. In these drawings, although only one end of the connector 3 is shown, the other end thereof is of the same in structure. In the connector 3 (SMT connector) surface-mounted to the board 2, such as a printed circuit board, contacts (not shown) of the connector 3 are arrayed within the housing 4, and exposed from a bottom surface of the connector 3 to be overlapped with and solder-fixed to respective contact pads on the board 2.

The insertion groove 6 preferably has a notch provided in the end portion of the housing 4. The mounting piece 15 of the bracket 10 is inserted into the insertion groove 6, so that the connector 3 and bracket 10 are firmly fixed to each other while being positioned in the longitudinal direction. The protruding portions 5 to which the bracket 10 is to be attached are protruded from the longitudinal ends of the insertion groove 6 so that the protruding portions 5 are juxtaposed to be opposed to each other. Each of the protruding portions 5 is formed with each of grooves 7 to which the arm portion 13 of the bracket 10 is to be fitted. The bracket 10 is disposed within a space defined between the opposed protruding portions 5.

Next, a screw fixing process of fixing the connector 3 to the board 2 will be described in detail. The screw fixing process is executed in the order from FIG. 1 to FIG. 3. FIG. 1 shows attaching the bracket 10 to the connector 3. The bracket 10 is positioned in the lateral direction and fixed by the arm portions 13 that are attached to the grooves 7 formed in the protruding portions 5 to clamp the protruding portions 5. By forming the grooves 7 in the protruding portions 5, the attachment of the arm portions 13, the positioning in the lateral direction and fixture can be positively conducted.

Concurrently, the mounting piece 15 is inserted into the insertion groove 6 in the direction toward the board 2 (i.e. in the downward direction of the drawing), thereby effecting the positioning in the longitudinal direction and the desired fixture. By providing the insertion groove 6 in the connector 3 and providing the mounting piece 15 of the bracket 10, the mounting of the bracket 10, the positioning in the longitudinal and lateral directions, and the fixture can be conducted positively. In this condition, the main body portion 11 is disposed within the space defined between the opposing protruded portions 5. By the above procedure, the bracket 10 is mounted to the connector 3.

The bracket 10 disposed as mentioned above is positioned in the longitudinal direction and in the lateral direction as shown in FIG. 2. As shown in FIG. 2, the bracket 10 is mounted in a stable manner. In this condition, the returningly folded piece 14 of the bracket 10 is contacted with the board 2.

FIG. 2 shows screw tightening for fixing the bracket 10 using the screw. The surface of the returningly folded piece 14, which is contacted with the board 2, is solder-fixed to the board 2 by reflow, to thereby fix the bracket 10 to the board 2. The solder-fixing is carried out without interfering with the screw hole portion. In addition, although the solder fixture is conducted using the reflow in this embodiment, the invention should not be restricted thereto; for example, the solder fixture may be conducted using a flow.

After the fixture by soldering is completed, the screw 1 is passed through the screw holes 12 from a side opposite to the board 2 (the upper side in FIG. 2) to a reverse side of the board 2, and then the screw 1 is tightened. As the screw 1 to be tightened, a generally available one, such as a tipping screw, is used. FIG. 3 shows a condition in which the screw tightening is complete. By the aforementioned step, the connector 3 is screw-fixed to the board 2 through the bracket 10.

Although the tapping screw is used as the screw 1 in this embodiment, the present invention should not be restricted thereto. For example, a screw hole may be preliminary formed through the board 2, and a bolt may be used as the screw 1 to be tightened. That is, such an arrangement may be adopted so that, after the bolt is passed through the hole, the bolt is tightened using a nut on a reverse surface of the board 2.

Figure 8:
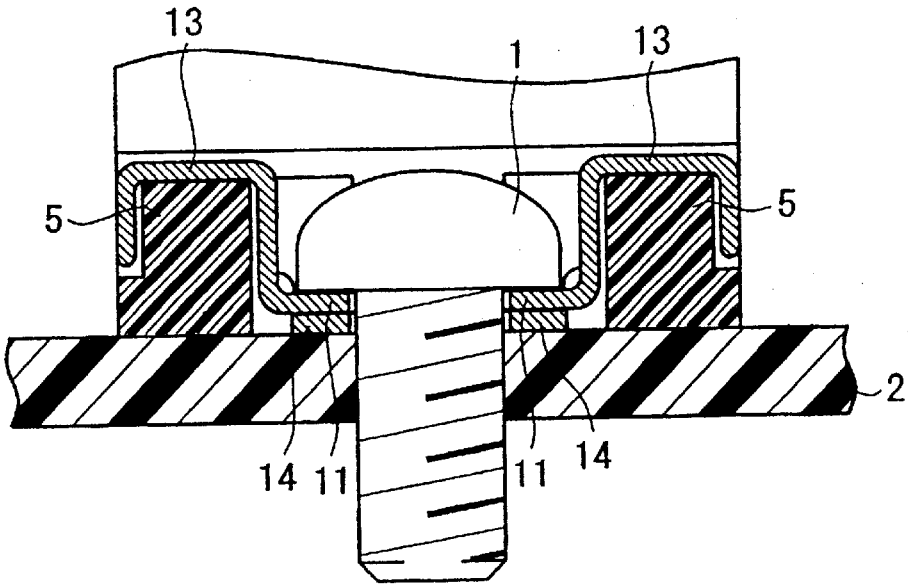
FIG. 8 is the same view as FIG. 7, showing the screw after tightening to the bracket.

Each of FIGS. 7 and 8 is a sectional view taken along line X—X of FIG. 2, showing a condition in which the bracket is screw-fixed to the board. FIG. 7 shows a condition before the screw tightening, and FIG. 8 shows a condition after the screw tightening.

In FIG. 7, character A denotes a clearance between the folded piece 14 soldered to the board 2 and the main body portion 11. Character B denotes a clearance between the protruding portion 5 and the arm portion 13. Comparing the clearances A and B, a relationship A>B is established.

When the screw 1 is tightened to attach the bracket 10, the screw 1 is moved in the direction toward the board 2 (i.e. in the downward direction in the Figures) as shown in FIG. 8. Accordingly, the main body portion 11 is depressed by the screw 1 in the direction toward the board 2, so that the clearance A disappears and the main body portion 11 is contacted with the folded piece 14. When the main body portion 11 is depressed in the direction toward the board 2, the arm portion 13 concurrently causes a force depressing the protruding portion 5 in the direction toward the board 2.

Here, since the clearances A and B have the relationship of A>B, that is, the clearance B is set to be smaller than the clearance A, when the main body portion 11 is contacted with the folded piece 14 by the force applied due to the screw tightening to depress the bracket 10 in the direction toward to the board, the clearance B also disappears. Thus, each arm portion 13 causes a stable and constant force for depressing each protruding portion in the direction toward the board 2.

On the other hand, the screw-tightening torque is applied to a portion to be tightened during the screw tightening. In the conventional example, a part of the connector is screw-fixed directly, and thus the problem such as the deformation or crack of the resin-made connector due to the screw-tightening torque is caused.

During the screw tightening in FIG. 8, the screw-tightening torque acts on the fixed metal bracket 10, and the load acting on the connector 3 is constant. Therefore, the aforementioned problem of the prior art is not caused. For this reason, the screw tightening for the bracket 10 can be conducted sufficiently. That is, it is free from a troublesome management for maintaining the screw-tightening torque to be relatively low, and insufficient screw tightening associated therewith. Accordingly, it is possible to ease the management of the screw-tightening torque during the fixture by screw.

Further, the screw tightening for the bracket 10 is sufficiently conducted, and during this screw tightening, the main body portion 11 also serves as a washer. By this, the screw tightening can be positively conducted, while the loosening of the screw can be eliminated afterwards. Accordingly, the period of reliability for the screw tightening is enhanced.

Moreover, since the main body portion 11 of the bracket 10 is folded to present the U-shape along 16 and provide the double structure, the folded piece 14 is used to define a preliminary contact position with the board surface, and the clearance A suitable for fixture by tightening the screw 1 is provided between the folded piece 14 and the main body portion 11. Thus, the folded piece 14 is fixed with the soldering in the operation prior to screw tightening.

Thereafter, even if the rotational moment due to the screw-tightening torque associated with the screw tightening for the bracket 10 is caused, the bracket never is rotated or shifted since the bracket 10 is fixed with the soldering. Accordingly, the excessive rotational moment never is applied to the connector 3 to which the bracket 10 is mounted. By fixing the bracket 10 to the board 2, it is possible to suppress the rotation and shift of the bracket 10 due to the screw-tightening torque, and it is also possible to suppress the problem in which the rotational moment due to excessive screw-tightening torque acts on the connector 3 to cause stress onto the solder tail portion of the connector 3.

Figure 10:
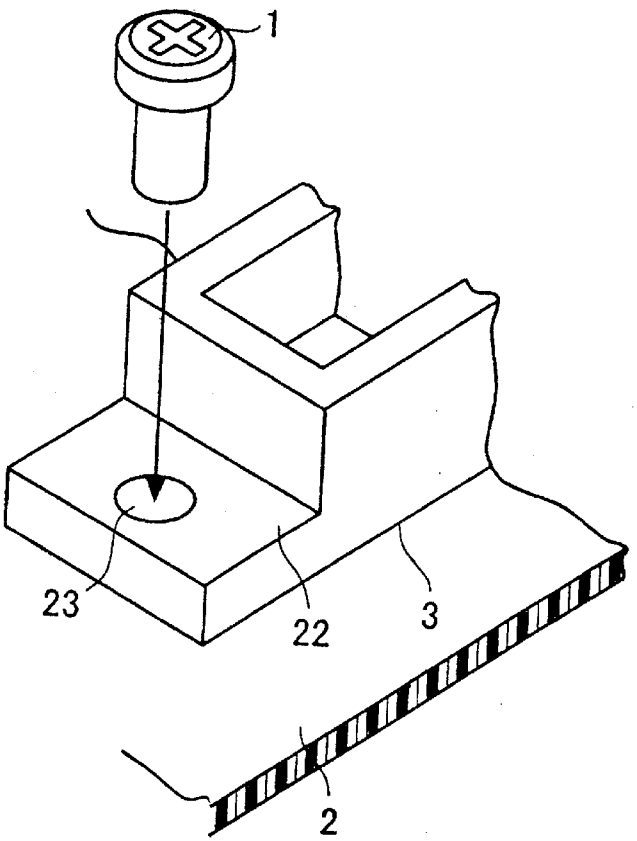
FIG. 10 Prior Art
FIG. 10 is a perspective view illustrating another prio art connector which is fixed to a circuit board by way of a screw; and, FIG. 11 is the same view as FIG. 10, but with the screw tightened and illustrating a stress crack in the connector, which may occur when screw is overtightened.
Figure 9:
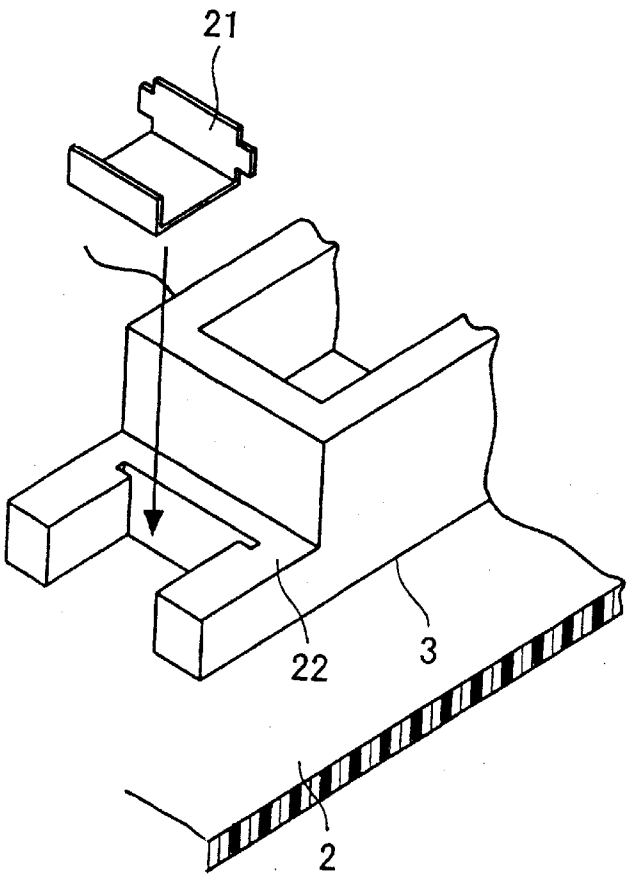
FIG. 9 Prior Art
FIG. 9 is a perspective view showing a prior art connector in which a fitting nail is used as a reinforcing member.

FIGS. 9 and 10 show arrangement examples of a fixing structure for a known connector of the prior art. FIG. 9 shows an arrangement example of a fixing structure of a connector in which a nail is used as a reinforcing member. As shown in FIG. 9, as a method of fixing a connector 3 to a board 2, a flange 22 is provided on an end portion of the connector 3, a nail 21 made of metal is attached to the flange 22, and a bottom surface of the nail 21, which is contacted with the board 2, is fixed thereto by soldering.

FIG. 10 shows an arrangement example in which a screw is used to fix a connector. The structure in which a connector is fixed by screwing is frequently employed as a fixing structure for a connector in the prior art. As shown in FIG. 10, a flange 22 formed with a hole or U-shaped groove for a screw is provided to the end portion of the connector 3. The screw 1 is passed through a hole 23 of the flange 22 and tightened, thereby fixing the connector 3 to the board 2.

However, the prior art described above suffers from the following problems. In the method for reinforcing the connector 3 using the nail 21 as shown in FIG. 9, the fixing to the board 2 is achieved only by the soldering, and consequently, the fixing force is unstable, and the reliability is low in view of the fixing strength.

On the other hand, in the method for fixing the connector 3 using the screw as shown in FIG. 10, if the tightening force for the screw 1 (i.e., the screw-tightening torque) is excessive, the compression force by the screw 1 is increased so much that the compression force exceeds the physical strength of the material of the flange 22. Consequently, as illustrated in FIG. 11, a problem, such as a deformation or crack in the flange 22, is caused.

For this reason, with this prior art approach, the screw-tightening force must be set relatively lower, and the screw tightening must be executed within a region where the deformation is not caused. However, if the screw tightening is insufficient, there may cause a loosening of the screw associated with a time-related change. Accordingly, it is necessary to determine the screw-tightening torque carefully and finely.

Further, when the screw is tightened to fix the connector 3, an excessive rotational moment due to the screw-tightening torque may act on the connector 3. Consequently, an unnecessary stress due to the rotational moment of the connector 3 is caused on a solder tail portion by which the connector 3 is solder-fixed to the board 2.

As described above, according to the present invention, the connector is not screw-fixed directly to the board, but the metal-made bracket having a double structure is mounted to the connector and then a screw tightening is conducted. Consequently, management of the screw-tightening torque can be made easy to enhance workability during screw fixing, and reliability of the screw tightening and time-related reliability of the screw fixture can be enhanced.

By preliminarily fixing the bracket to the board prior to the screw tightening, it is possible to suppress the rotation of the bracket due to the screw-tightening torque, and to suppress a problem in which unnecessary rotational moment due to excessive screw-tightening torque acts on the connector to cause stress onto the solder tail portion of the connector.

It will be understood that the embodiments of the present invention which have been described are illustrative of some of the applications of the principles of the present invention. Numerous modifications may be made by those skilled in the art without departing from the true spirit and scope of the invention.

What is claimed is:

1. A structure for fixing a surface mount connector to a circuit board, comprising:

a connector housing having a pair of opposing ends, at least one of the connector housing ends including a pair of protruding portions extending outwardly from the one end and spaced apart from each other; and, a bracket seated on the protruding portions, and a screw for fixing the bracket to the circuit board, the bracket including a main body portion disposed between the pair of protruding portions, right and left arm portions extending from the bracket main body portion for clamping said pair of protruding portions to said circuit board, and an opening disposed in said bracket main body for receiving the screw, said bracket main body portion further including a bottom flap with a folded piece that is folded upon said main bracket main body portion, the folded piece being in contact with an opposing surface of said circuit board, the bracket right and left arm portions being sized and shaped such that when said screw is tightened, each of the bracket right and left arm portions are pressed against said protruding portions in a direction toward the board.

2. The surface mount connector fixing structure as claimed in claim 1, wherein said bracket is stamped and formed from sheet metal.

3. The surface mount connector fixing structure as claimed in claim 1, wherein the protruding portions each include a recess, into which said bracket arm portions are received.

4. The surface mount connector fixing structure as claimed in claim 1, wherein said connector housing further includes an insertion groove extending between said protruding portions, and said bracket includes a mounting leg received by said insertion groove when said bracket is applied to said connector housing protruding portions.

5. The surface mount connector fixing structure as claimed in claim 4, wherein said bracket mounting leg extends from said bracket main body portion at a location generally opposite to a foldline of said folded piece.

6. The surface mount connector fixing structure as claimed in claim 1, wherein said folded piece and bracket main body portion are spaced from each other by a first clearance, the first clearance being defined prior to said bracket being fixed to said circuit board by said screw.

7. The surface mount connector fixing structure as claimed in claim 6, wherein at least one of said bracket arm portions is spaced apart from an opposing connector protruding portions and at least one of said arm portions by a second clearance, the second clearance being defined prior to said bracket being fixed to said circuit board by said screw.

8. The surface mount connector fixing structure as claimed in claim 7, wherein said first clearance is greater than said second clearance prior to said bracket being fixed to said circuit board by said screw.

9. An attachment bracket for use in attaching an electrical connector to a circuit board, the connector including a housing, the housing having at least one end and a pair of mounting legs projecting therefrom, the mounting legs being spaced apart from each other to define an intervening space, the attachment bracket comprising:

a main body including a plurality of side edges that cooperatively define opposing top and bottom working surfaces of said attachment bracket, an opening formed in the bracket main body and extending completely through said top and bottom surfaces thereof, said bracket main body being dimensioned to be received within said intervening space, said attachment bracket further including a pair of attachment arms extending outwardly from a pair of opposing side edges of said bracket main body, the attachment arms presenting a stepped surface that is received on said connector housing mounting legs, said bracket main body being formed by folding a plate upon itself to define said bracket main body top and bottom surfaces, said bracket main body top and bottom surfaces being spaced apart from each other separated by an intervening clearance, said top and bottom surfaces of said bracket being movable toward each other under pressure of a screw inserted into said opening and tightened.

10. The attachment bracket of claim 9, wherein said bracket main body top and bottom surfaces are connected together along a foldline that extends between two opposing side edges of said bracket main body.

11. The attachment bracket of claim 9, wherein said bracket main body top surface and said two attachment arms are spaced vertically apart from each other and lie in different planes.

12. The attachment bracket of claim 9, further including a retention arm that extends between said two attachment arms and which is received within a corresponding retention groove formed in said connector housing.

13. The attachment bracket of claim 9, wherein a second clearance is defined between said attachment arms and said connector mounting legs when said main body is inserted into said space between said connector mounting legs and prior to the tightening of the screw, the second clearance B being less than said clearance between said top and bottom surfaces of said bracket main body.

14. A structure for fixing a surface mount connector to a circuit board, comprising:

a connector housing having a pair of opposing ends, at least one of the connector housing ends including a pair of protruding portions extending outwardly from the one end and spaced apart from each other; and, a bracket seated on the protruding portions, and a screw for fixing the bracket to the circuit board, the bracket including a main body portion disposed between the pair of protruding portions, right and left arm portions extending from the bracket main body portion for clamping said pair of protruding portions to said circuit board, and an opening disposed in said bracket main body for receiving the screw, the bracket right and left arm portions being sized and shaped such that when said screw is tightened, each of the bracket right and left arm portions are pressed against said protruding portions in a direction toward the board, and said connector housing further including an insertion groove extending between said protruding portions, and said bracket includes a mounting leg that is received by said insertion groove when said bracket is applied to said connector housing protruding portions.

* * * * *